US010443226B2

(12) United States Patent
Lupien

(10) Patent No.: US 10,443,226 B2
(45) Date of Patent: Oct. 15, 2019

(54) ANCHOR FOR SECURING A POST TO DECK ELEMENTS, AND A DECK ASSEMBLY THEREWITH

(71) Applicant: Katchaba Imports Inc., Pointe-Claire (CA)

(72) Inventor: Gilles Lupien, Laval (CA)

(73) Assignee: Katchaba Imports Inc., Pointe-Claire, Qc (CA)

( * ) Notice: Subject to any disclaimer, the term of this patent is extended or adjusted under 35 U.S.C. 154(b) by 23 days.

(21) Appl. No.: 15/358,205

(22) Filed: Nov. 22, 2016

(65) Prior Publication Data

US 2018/0142462 A1 May 24, 2018

Related U.S. Application Data

(60) Provisional application No. 62/259,417, filed on Nov. 24, 2015.

(51) Int. Cl.
*E04H 12/12* (2006.01)
*E04B 1/00* (2006.01)
*E04B 5/02* (2006.01)

(52) U.S. Cl.
CPC ..... *E04B 1/003* (2013.01); *E04B 5/02* (2013.01)

(58) Field of Classification Search
CPC ..... E04F 11/1812; E04F 15/02452; E04H 12/2261; E04H 12/2269; E04B 1/003
See application file for complete search history.

(56) References Cited

U.S. PATENT DOCUMENTS 1,013,004 A * 12/1911 Ernst ..... F16B 7/0446 403/190
3,318,057 A * 5/1967 Norsworthy ..... E04F 15/02452 52/126.6
3,921,356 A * 11/1975 Hughes ..... E04B 1/2604 52/299
4,313,688 A * 2/1982 Daniels ..... E04B 1/2608 403/189
4,614,070 A * 9/1986 Idland ..... E04H 12/2253 52/295
4,759,162 A * 7/1988 Wyse ..... E04H 3/24 52/126.6
5,392,575 A 2/1995 Hoffman et al.
5,819,482 A 10/1998 Belke et al.
5,852,895 A * 12/1998 Sinanan ..... A01G 9/022 47/33
6,345,474 B1 2/2002 Triplett
(Continued)

OTHER PUBLICATIONS http://www.doityourself.com/forum/decks-patios-walkways-stairs-steps-docks/483303-decking-questions.html, Dec. 1, 2012.*

*Primary Examiner* — Brian D Mattei
*Assistant Examiner* — Daniel J Kenny
(74) *Attorney, Agent, or Firm* — Agence de Brevets Fournier

(57) ABSTRACT

An anchor for securing deck elements to a post comprises a body having first and second opposite sides. The first side of the body has an opening for receiving the post along a first axis in a snugly-fit manner. The second side of the body has a generally flat surface generally perpendicular to the first axis for securing the deck elements thereon, and positioning guide members extending from the generally flat surface so as to define therewith areas for receiving and relative positioning of the deck elements.

9 Claims, 22 Drawing Sheets

(56) References Cited

U.S. PATENT DOCUMENTS

| | | | | |
|---|---|---|---|---|
| 7,278,240 | B2 | 10/2007 | Burkart et al. | |
| 8,011,148 | B2 | 9/2011 | Bertke et al. | |
| 8,112,947 | B2 * | 2/2012 | Mead | E04F 15/02452 52/126.4 |
| 8,622,364 | B2 * | 1/2014 | Bergman | E04H 12/2261 248/523 |
| 8,959,857 | B1 * | 2/2015 | Lin | E04H 12/2261 256/65.14 |
| 9,004,439 | B2 * | 4/2015 | Gross | E04H 12/2269 248/507 |
| 9,661,917 | B2 * | 5/2017 | Dias | A47B 13/003 |
| 2007/0235616 | A1 * | 10/2007 | Gross | E04H 12/2261 248/346.5 |

* cited by examiner

ANCHOR FOR SECURING A POST TO DECK ELEMENTS, AND A DECK ASSEMBLY THEREWITH

CROSS REFERENCE TO RELATED PATENT APPLICATION

This application claims the benefit of U.S. Provisional Application No. 62/259,417, filed on Nov. 24, 2015, the content of which is incorporated by reference herein.

FIELD

The present disclosure relates to elevated constructions such as decks, patios and the like. More specifically, the present disclosure relates to anchors for securing a post to deck elements.

BACKGROUND

Kits for the assembly of a patio, deck or the like are well-known. Parts of such kits can be selected and assembled in different ways by non-professionals to yield a patio or deck having a personalized configuration.

Some of these kits include posts and/or joists that are pre-cut in such a way as to allow their interconnection without any anchors therebetween. More generally, angle irons are used to secure such deck or patio elements.

No anchor element is presently known that allows both easy relative positioning and assembly of a post to deck elements.

SUMMARY

According to an illustrative embodiment, there is provided an anchor for securing a post to deck elements post comprising:

a body having first and second opposite sides;

the first side of the body having an opening for receiving the post along a first axis in a snugly-fit manner; and the second side of the body having:

at least one surface oriented generally perpendicular to the first axis for securing the deck elements thereon, and positioning guide members adjacent the at least one surface so as to define therewith areas for receiving and relative positioning of the deck elements.

According to another illustrative embodiment, there is provided a deck assembly comprising:

a frame structure including ledgers, and joists secured to the ledgers;

each of the ledgers and joists having at least one longitudinal side provided with a shoulder portion;

the ledgers and joists being assembled so as to define tile-receiving portions therebetween; and a plurality of tiles mounted to the frame structure, each within a respective tile-receiving portion so as to be supported by the shoulder portion;

a plurality of posts that support the frame structure and that are mounted thereto via anchors;

each of the anchors being defined by a body having first and second opposite sides;

the first side of the body having an opening for receiving one of the plurality of posts along a first axis in a snugly-fit manner; and at least one surface oriented generally perpendicular to the first axis for securing selected ones of the ledgers and joists thereon, and positioning guide members adjacent the at least one surface so as to define therewith areas for receiving and relative positioning of at least two of the ledgers and joists.

According to still another illustrative embodiment, there is provided a kit for assembling a deck, the kit comprising:

a plurality of frame elements to be assembled into a frame structure;

a plurality of tiles to be mounted to the frame structure to yield a deck platform;

a plurality of posts to support the deck platform; and a plurality of anchors, each defined by a body having first and second opposite sides;

the first side of the body having an opening for receiving one of the plurality of posts along a first axis in a snugly-fit manner; and the second side of the body having at least one surface, each oriented generally perpendicular to the first axis for securing at least two of the frame elements thereon.

The expression "deck element" should be construed in the description and in the claims so as to include ledgers, joists, interjoists, joist spacers and any frame or support components of a deck patio and the like.

Other objects, advantages and features of the anchor for securing a post to deck elements will become more apparent upon reading the following non-restrictive description of preferred embodiments thereof, given by way of example only with reference to the accompanying drawings.

BRIEF DESCRIPTION OF THE DRAWINGS

In the appended drawings:

FIG. 2 is a bottom perspective of an irregularly-shaped deck assembled using a plurality of rectangular and triangular-shaped deck section;

DETAILED DESCRIPTION

Figure 1A:
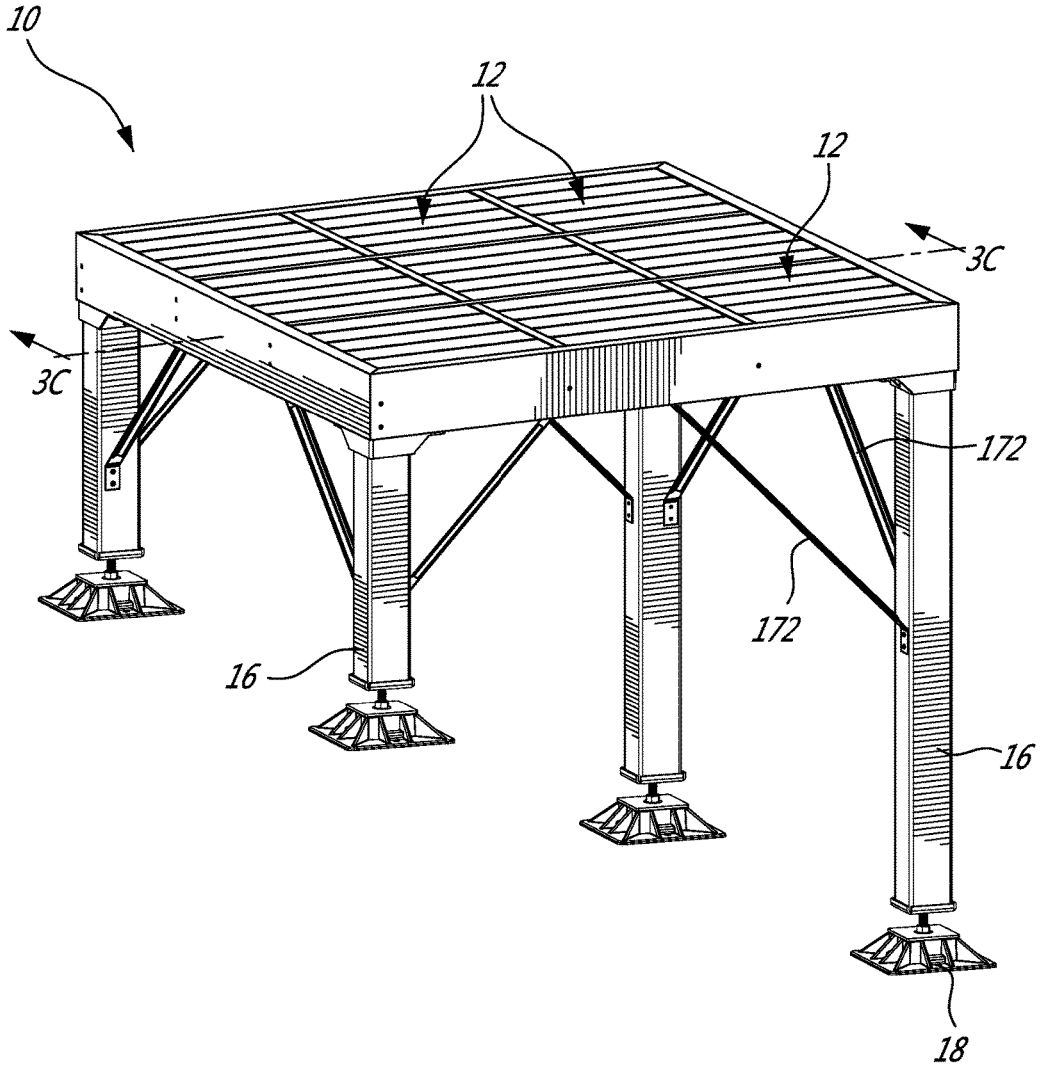
FIGS. 1A and 1B are respectively top and bottom perspectives of a rectangular deck according to a first illustrative embodiment.

In the following description, similar features in the drawings have been given similar reference numerals, and in order not to weigh down the figures, some elements are not referred to in some figures if they were already identified in a precedent figure.

The use of the word "a" or "an" when used in conjunction with the term "comprising" in the claims and/or the specification may mean "one", but it is also consistent with the meaning of "one or more", "at least one", and "one or more than one". Similarly, the word "another" may mean at least a second or more.

As used in this specification and claim(s), the words "comprising" (and any form of comprising, such as "comprise" and "comprises"), "having" (and any form of having, such as "have" and "has"), "including" (and any form of including, such as "include" and "includes") or "containing" (and any form of containing, such as "contain" and "contains"), are inclusive or open-ended and do not exclude additional, unrecited elements.

Figure 1B:
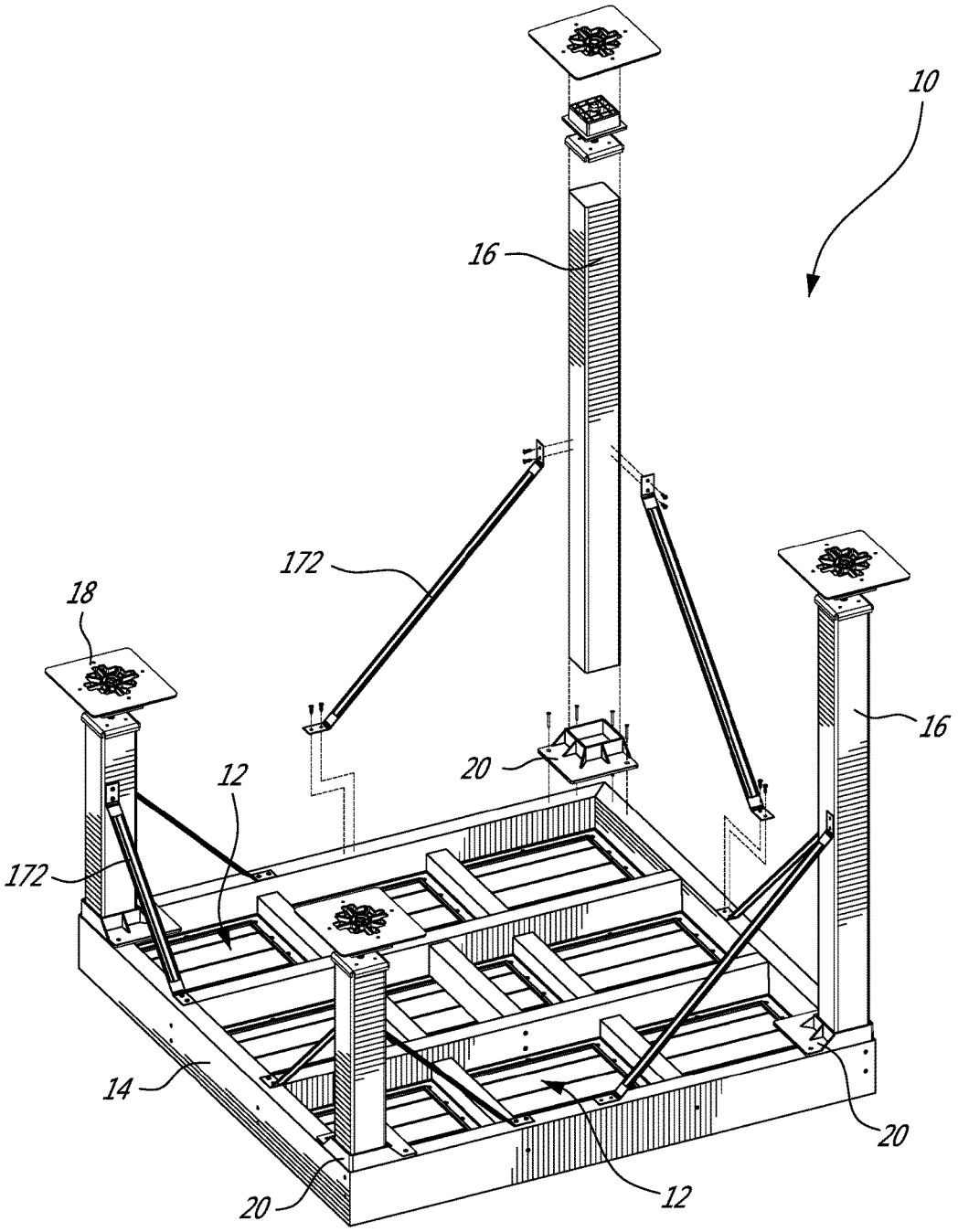

With reference to FIGS. 1A-1B, a deck 10 assembled from a modular kit according to a first illustrative embodiment will now be described. According to this first embodiment, the assembled deck 10 includes a single rectangular section. However, as can be seen for example in FIGS. 2 and 5A-5B, the kit allows assembling a deck including a plurality of rectangular or triangular-shaped sections.

Returning to FIGS. 1A-1B, the deck 10 includes a plurality of rectangular tiles 12 mounted to a frame structure 14. The rectangular frame structure 14 is supported and distanced from the ground by a plurality of posts 16, which are mounted onto adjustable structural piers 18 and secured to the frame structure 14 via anchors 20. As can be seen in FIGS. 1A-1B, the posts 16 can be of different lengths.

The kit includes various elements allowing to assemble the tiles 12, the frame structure 14 and an appropriate number of posts 16, structural piers 18 and anchors 20 allowing to assemble the deck 10.

Each of these elements and pieces of the kit will now be described in more detail.

Figure 3A:
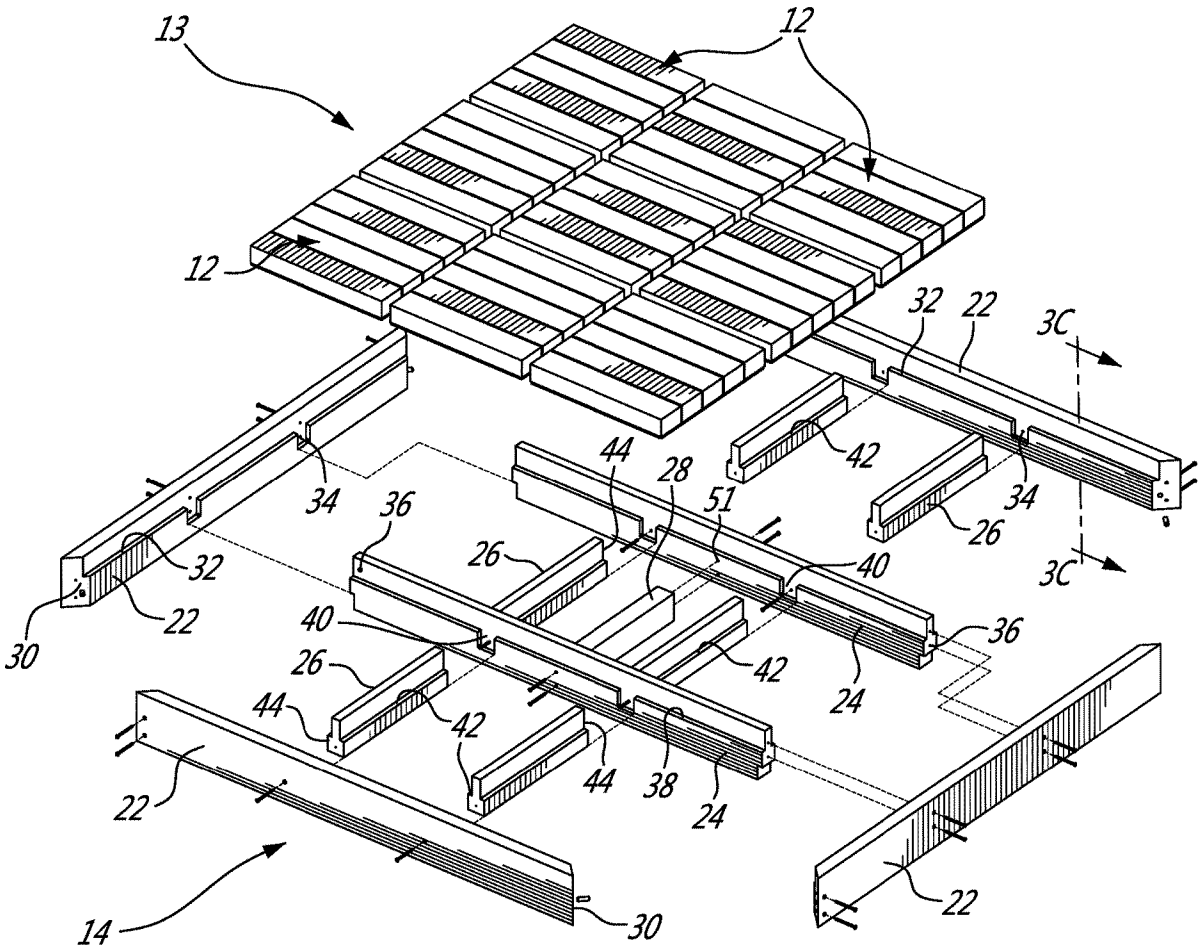
FIGS. 3A and 3B are respectively an exploded perspective and a cross-section of the tiles and frame structure of the deck from FIG. 1A.
Figure 3B:
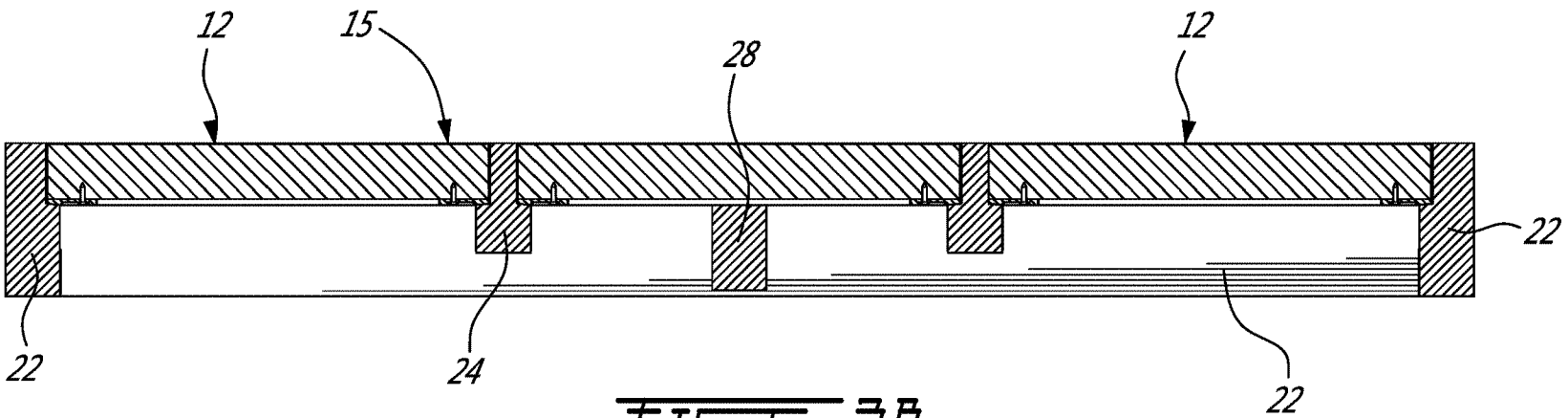

FIG. 3A shows parts of the kit allowing to assemble the tiles 12 and frame structure 14 of the deck from FIG. 1A, yielding a rectangular-shaped deck platform 13. Together the frame structure 14 and tiles 12 define a deck section 15 (see also FIG. 3B). According to some embodiments, a different kit is provided for each platform of a given shape and size and the posts 16. Structural piers 18 and anchors 20 can be provided separately.

According to another embodiment (not shown), the deck 10 is mounted onto structural piers that are not adjustable. According to a further embodiment, the structural piers are omitted.

The frame structure 14 includes four (4) ledgers 22, two joists 24, a series of interjoists 26 and a joist spacer 28. The ledgers 22, joists 24, interjoists 26 and spacer 28 are made of wood. According to another embodiment, the pieces 22-28 are made of a polymeric or hybrid material.

The longitudinal ends 30 of the peripheral ledgers 22 are cut at angles such that the four ledgers 22 define a rectangle when they are abutted. Each ledger 22 includes a shoulder portion 32 having two rectangular grooves 34 on the inner lateral side thereof. The grooves 34 are generally equally distanced from each other and from the longitudinal ends 36.

The longitudinal ends 36 of the joists 24 define tongue portions that are shaped for mating with the grooves 34. The interjoists 24 further include a longitudinal shoulder 38 on both lateral sides thereof that are similar to the shoulder portion 32 of the peripheral ledgers 22. Also, similarly to the ledgers 22, each joist 24 includes two rectangular grooves 40. However, as a difference with the grooves 34, pair of registered grooves 40 are provided on both lateral side of the beams 24.

The interjoists 26 have an inverted T-shaped cross-section defining longitudinal shoulders 42 on both lateral side. The width at the base of the interjoists 26 is such that their longitudinal ends 44 can be received in a pair of aligned grooves 40 of two adjacent joists 24 and in a pair of grooves 34 and 40 of a parallel pair of a ledgers 22 and joists 24 respectively.

A spacer block 28 is further added between the pair of joists 24 to add rigidity to the frame structure 14. The spacer block 28 is secured to both interjoists 24 therebetween using fasteners.

Figure 3C:
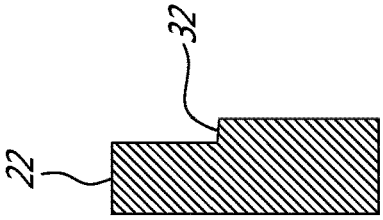
FIG. 3C is a cross-section taken along line 3B-3B in FIG. 3A.

As illustrated in FIG. 3C, the shoulder portions 32, 38 and 42 defines a five (5) degrees angle with the longitudinal top side of the corresponding deck element. Such an angle allows the draining of any water that can found its way on the shoulder portion while still resulting in a good support for the tiles 12 laid thereon.

According to another embodiment (not shown), the angle is different than five degrees.

The above-described elements of the frame structure 14 are assembled using fasteners 46 and/or nails 48. Other fastening means, such as brackets or adhesive (not shown) can also be used.

Once assembled, the frame structure 14 defines a plurality of tile-receiving rectangular interspaces, wherein the shoulder portions 32, 38 and/or 42 together define a rectangular inner flange to receive and support the tiles 12.

As shown in FIG. 2, frame elements 22-28 can be assembled in many ways to define decks of various sizes and configurations. A given deck configuration can be assembled using one or a plurality of kits including each a predetermined set of elements 22-28. Such kits can be supplemented by individual element 22-28 or a group thereof.

Figure 5A:
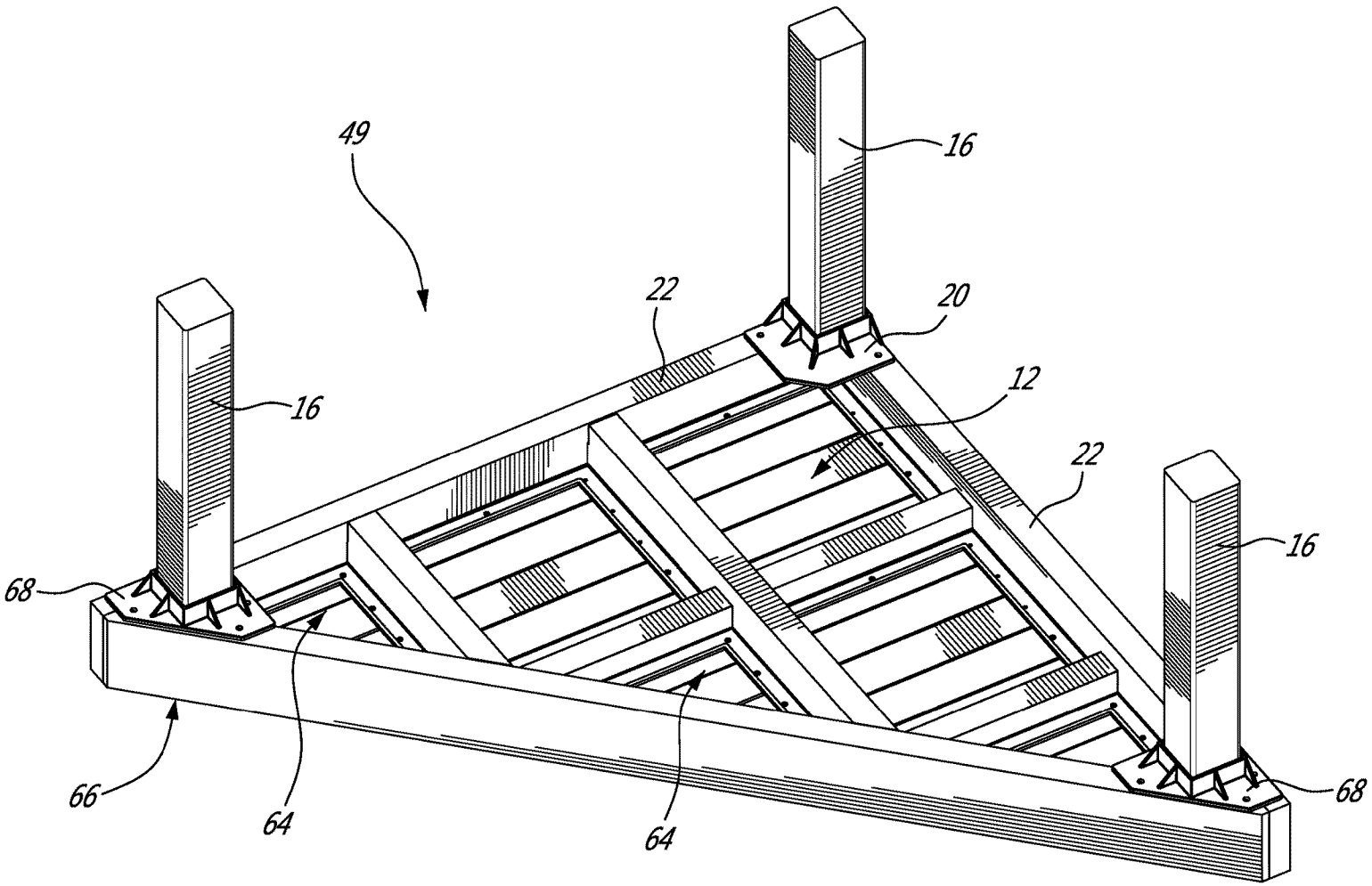
FIG. 5A is a bottom perspective showing one of the triangular-shaped deck section from FIG. 2.
Figure 5B:
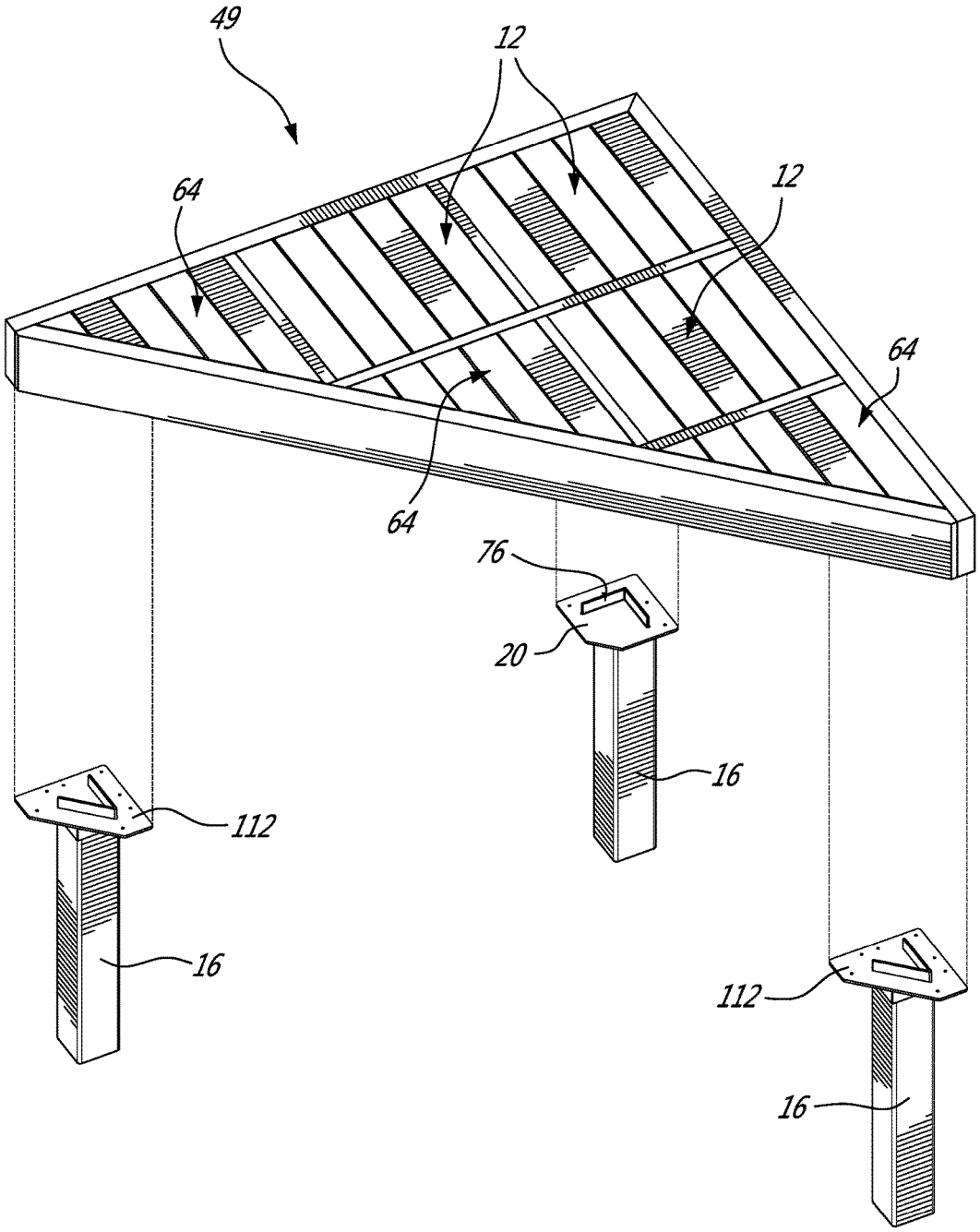
FIG. 5B is a top perspective partly exploded view of the triangular-shaped deck section from FIG. 5A.

For example, the deck of FIG. 2 is assembled using four (4) kits to assemble a rectangular deck platform 15 and five (5) kits for a triangular deck platform 49. FIGS. 5A-5B show a triangular-shaped deck section 49.

Also, the longitudinal ends of the elements 22-28 are not limited to being cut at a specific angle, and different elements provided with different cuts and or shape at their longitudinal ends can be provided. The configuration and size of the grooves 34 and 40 and shoulder portions 32 and 38 can also be different than those illustrated.

According to the first illustrative embodiment, the frame elements 22-28 are provided with factory-made fastener-receiving holes 50 and 51. According to another embodiment, the frame elements 22-28 do not include such holes, but include guiding marks (not shown) to help a user correctly positioned the fasteners. According to still another embodiment, some or all of the frame elements 22-28 are free of holes or guiding marks.

Figure 4B:
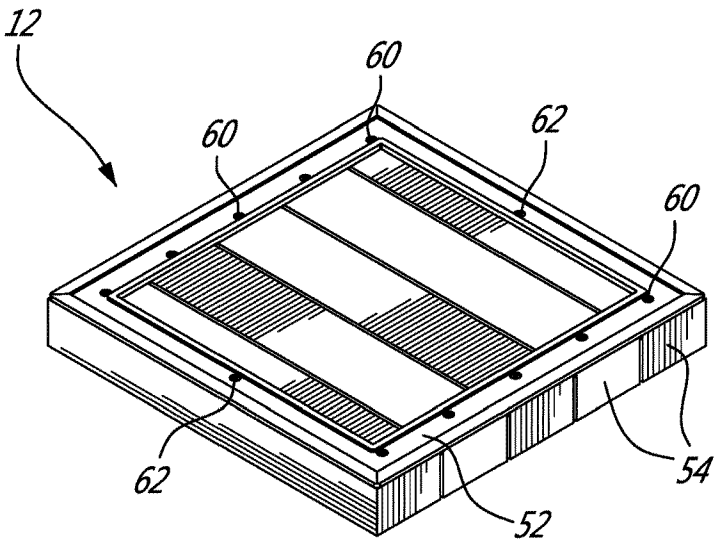
FIG. 4B is a perspective of the tile from FIG. 4A, showing the underside thereof.
Figure 4A:
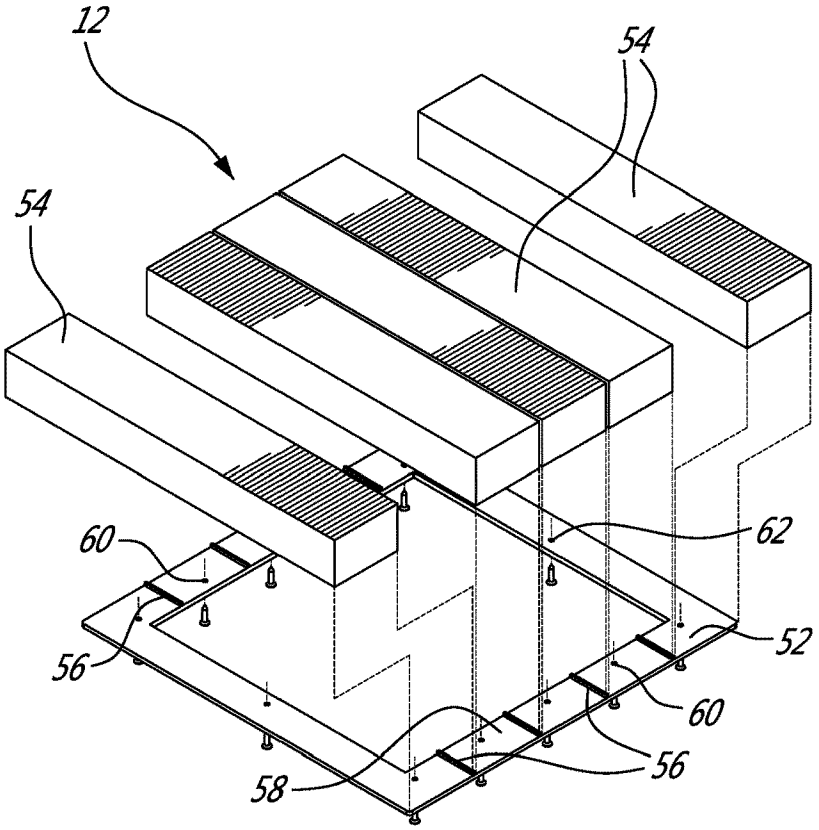
FIG. 4A is a top exploded perspective of a tile from the deck of FIG. 1A.

Turning now to FIGS. 4A and 4B, a rectangular tile 12 will now be described in more detail.

The tile 12 include a rectangular frame 52 and a plurality of rectangular pieces of wood 54 secured to the frame 52 side by side in a parallel relationship.

The frame 52 is made for example of a polymeric or metallic material and includes distanced ridges 56 on two parallel sides of the frame 52. The ridges 56 are parallel to the two other sides of the frame and each is aligned with a corresponding ridge 56 on the opposite side of the frame 52. The ridges 56 defines wood pieces receiving portions 58 therebetween and help in positioning and aligning the pieces of wood 54 on the frame 52. According to another embodiment (not shown), the frame 52 is free of such ridges 56.

The frame includes fastener-receiving holes 60 to secure the pieces 54 on the frame 52 and other holes 62 for securing the tiles 12 to the structure 14.

The tiles 12 are also not limited to being made of wood or to having the structure shown in FIGS. 4A-4B.

The tiles may also be made of a polymeric material, concrete, metal, or any combination thereof.

Figure 4C:
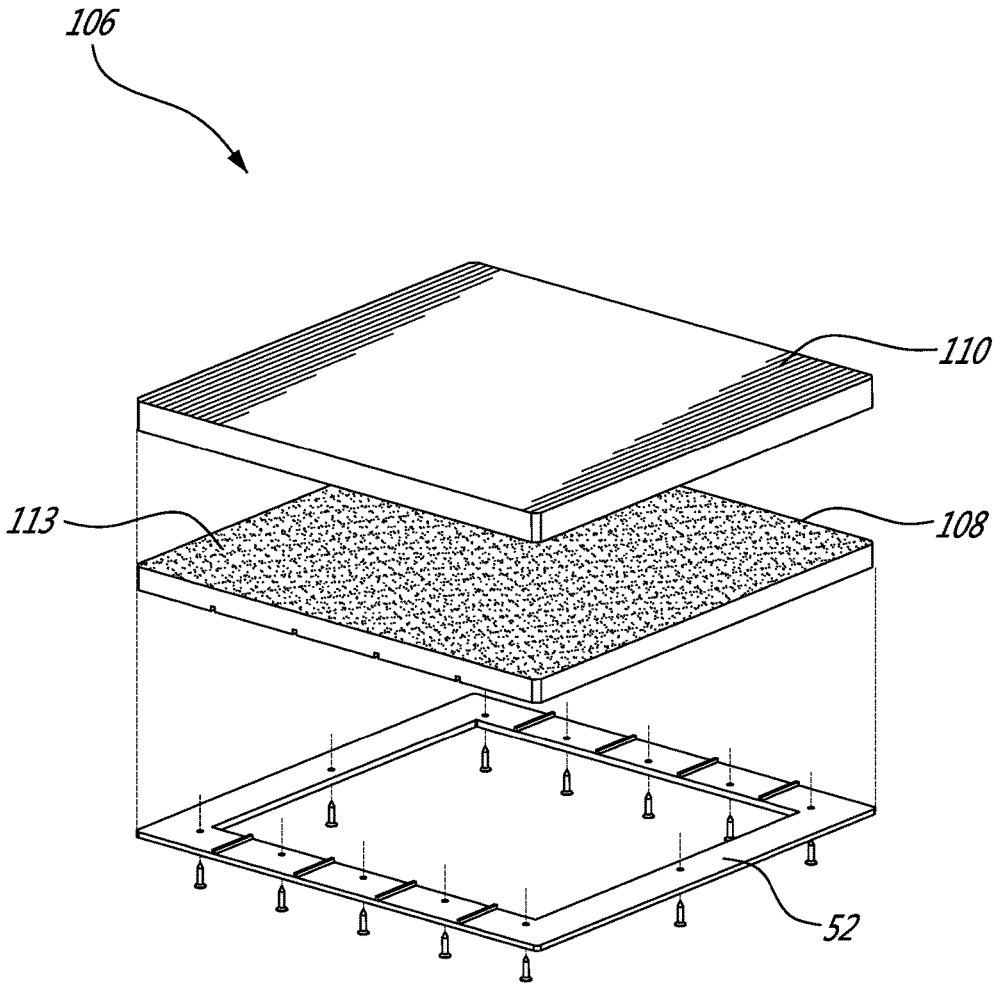
FIG. 4C is an exploded perspective view of a second illustrative embodiment a tile.

FIG. 4C shows a ceramic tile 106 that can be mounted to the same frame structure 14 than the tiles 12.

The tile 106 includes a frame 52, a similarly sized wood board 108 secured to the frame 52 using fasteners and a ceramic tile 110, also similarly sized to the frame 52, that is secured to the board 108 using for example cement glue 113.

Figure 6A:
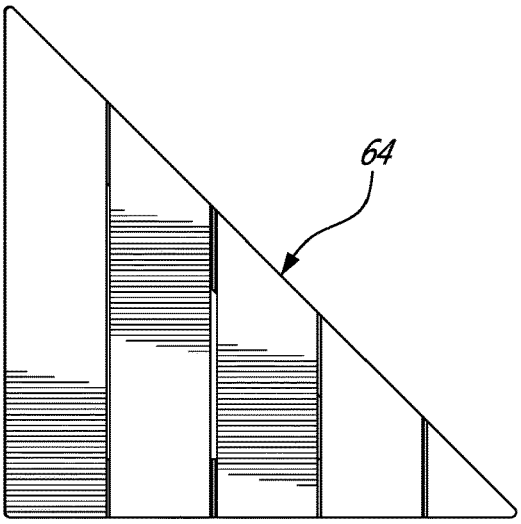
FIGS. 6A-6C are respectively top plan, bottom plan and exploded perspective views of a triangular-shaped tile of the triangular-shaped deck section of FIG. 5A.
Figure 6B:
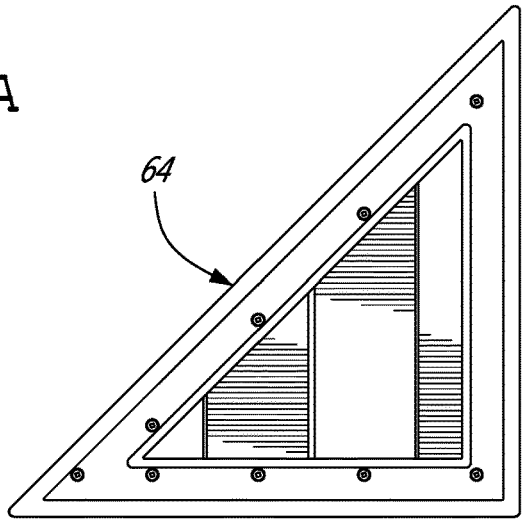
Figure 6C:
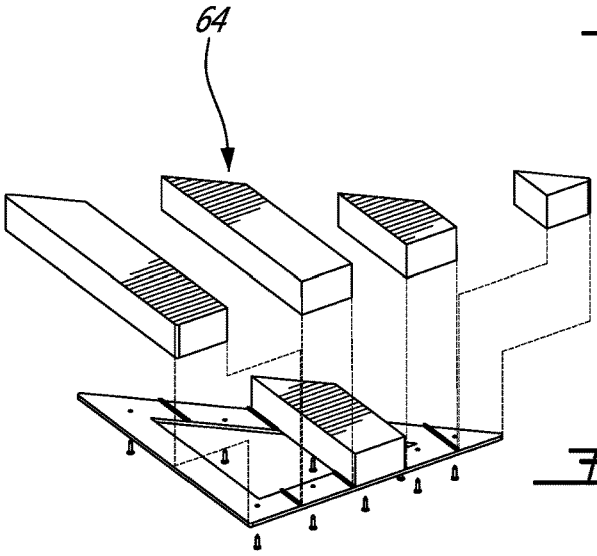
Figure 7:
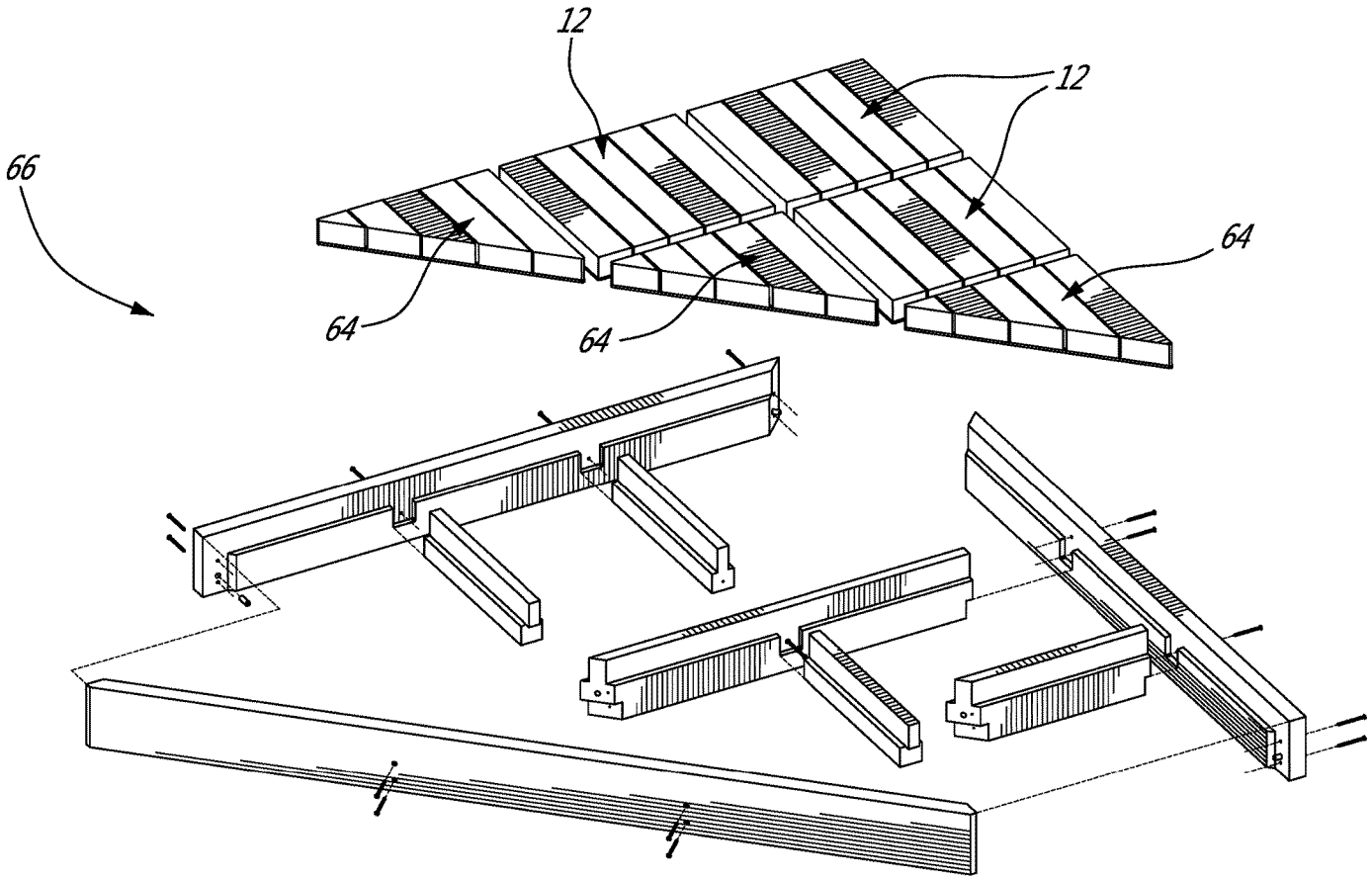

As can be seen in FIGS. 6A-6C, which shows a tile 64 that is similar to the tile 12 but that is triangular-shaped, there is no limit in the overall shape of the tiles.

Figure 7:
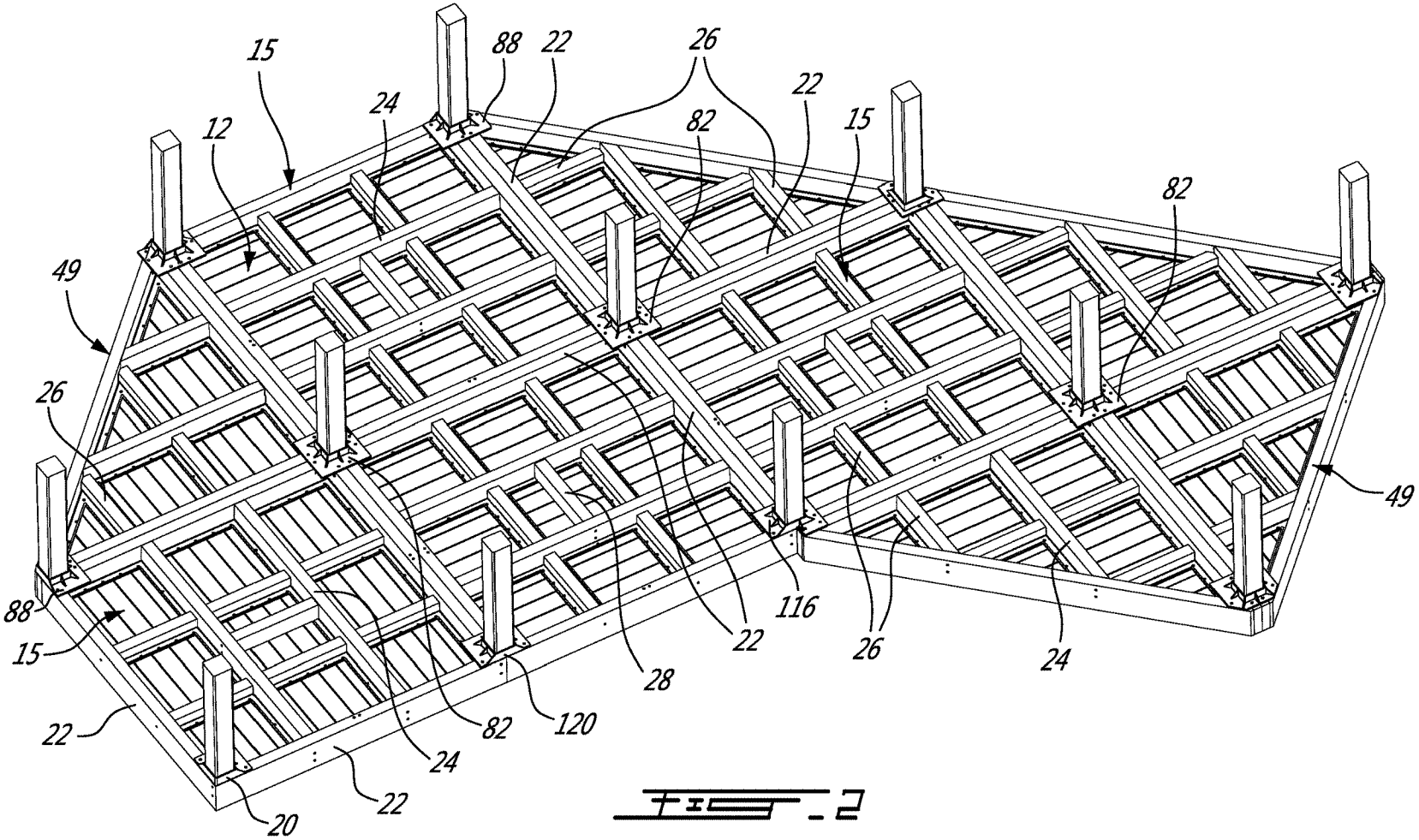
FIG. 7 is an exploded perspective of the deck platform from the deck section shown in FIG. 5A.

With reference to FIG. 7, a combination of rectangular and triangular-shaped tiles 12 and 64 is used to assemble the platform 66 of the triangular-shaped deck section 49 of FIGS. 5A-5B.

The triangular-shaped platform 66 is further assembled with elements similar to the elements 22-28 of a rectangular-shaped platform 13 of FIG. 3A. Differences between the two platforms 13 and 66 include the number, length and/or cut angle of the ledgers, joists, interjoists and spacer.

As shown in FIGS. 5A and 5B, the triangular-shaped deck section 49 results from securing posts 16 to the triangular-shaped deck platform 66 using anchors 20 and 112.

Figure 8A:
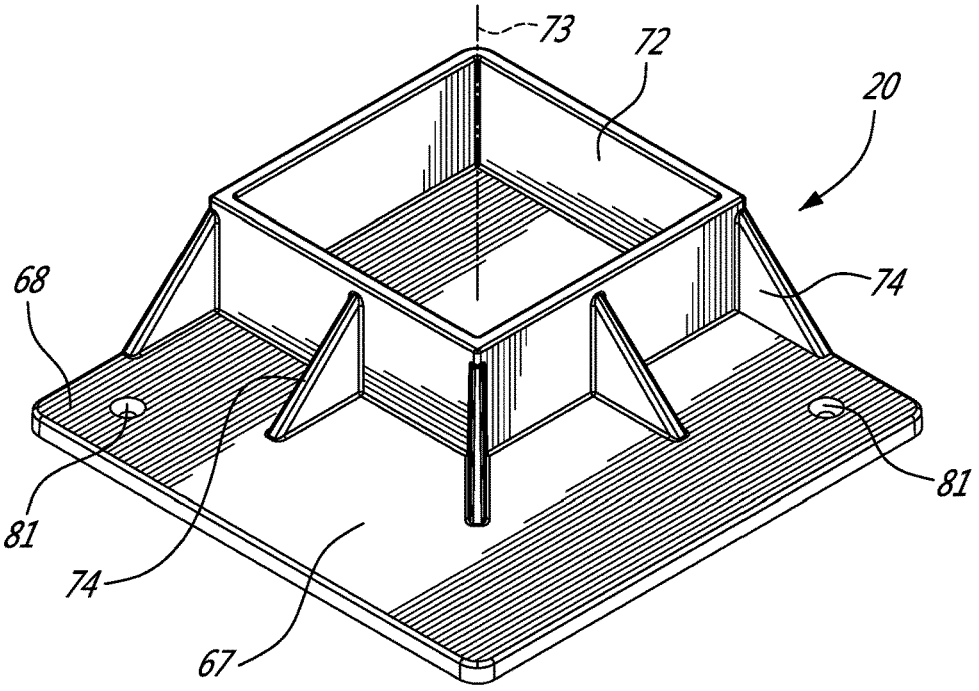
FIGS. 8A to 16B are bottom and top perspectives of different illustrative embodiments of anchors for securing a post to joist members in a deck assembly.
Figure 8B:
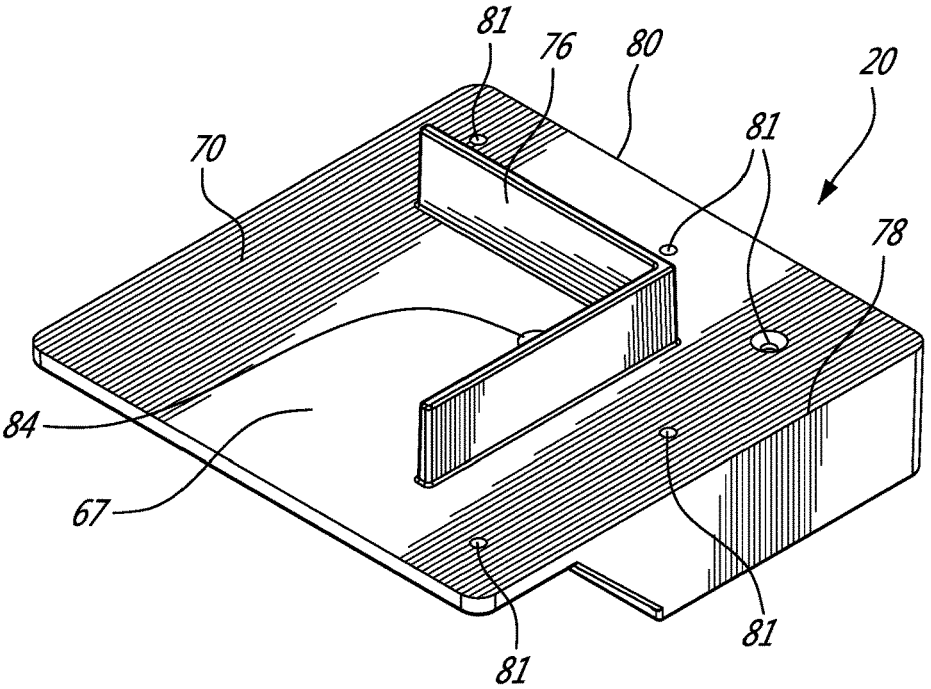

With reference to FIGS. 8A and 8B, the anchor 20, which is adapted to interconnect and secure to a post 16 two deck elements 14 will now be described in more detail. More specifically, the anchor 20 is configured for relative positioning of two ledgers 14 or other pieces of lumber at a ninety (90) degrees angle.

As will become more apparent upon reading the following description, different anchors are provided for relative positioning of two or more deck elements at different angle.

The anchor 20 is a one-piece plastic body, resulting for example from moulding, including a generally rectangular plate 67 defining opposite post-receiving side 68 and ledger-receiving side 70. The plate 67 is rectangular with rounder corner.

The post-receiving side 68 includes a rectangular wall 72 that protrudes perpendicular from the plate 67. The wall 72 is sized for receiving in a snuggly-fit manner a rectangular post 16 along a first axis 73. The side 70 further includes wall-reinforcing elements 74 extending from the wall 72.

The plate 67 defines a generally flat surface on the ledger-receiving side 70 that extends generally perpendicularly to the axis 73.

The ledger-receiving side 70 includes an L-shaped wall 76 that defines positioning guides for the two ledgers 22.

More specifically, each ledger 22 is positioned so as to lean against a respective leg of the L-shaped wall 76 between the wall 76 and a respective side edge 78, 80 of the anchor 20. The ledger 22 that is positioned between the wall 76 and the edge 78 has one of its longitudinal end registered with the edge 80, and the other ledger 22 has one of its longitudinal edge abutted onto the lateral side edge the first ledger 22.

The anchor 20 includes first fastener-receiving holes 81 for securing the ledger 22 thereto and s second fastener-receiving hole 84 for securing the post 16.

A person-skilled in the art will now appreciate that the anchor 20 is configured and sized to mount and secure a post 16 to the frame structure 14 underside thereof. More specifically, the anchor 20 is adapted to secure a post 16 to a portion of the structure 14 where two or more beams thereof interconnect at specific angle.

According to another embodiment, other positioning guide members than walls can be provided on the deck element-receiving side so as to define therewith areas for receiving and relative positioning of the deck elements. Such other positioning guide may include, without limitations, grooves, markings and protrusions.

While the anchor 20 is adapted for its mounting to two beams abutted perpendicularly, a kit according to an illustrative embodiment may include other anchors 82, 88, 109, 112-120 that are adapted to be secured to a different number of beams and/or beams defining different angles therebetween.

Also, the anchors 20 are adapted to receive and interconnect beams and/or posts of specific sizes and shapes. Differently configured and sized anchors 20 can be provided to receive and interconnect beams and/or posts of different configurations and/or sizes.

Examples of other anchors will now be described with reference to FIGS. 9A to 16C. Since these anchors are similar to the anchor 20, only the differences therewith will be described herein in more detail for concision purposes.

Figure 9A:
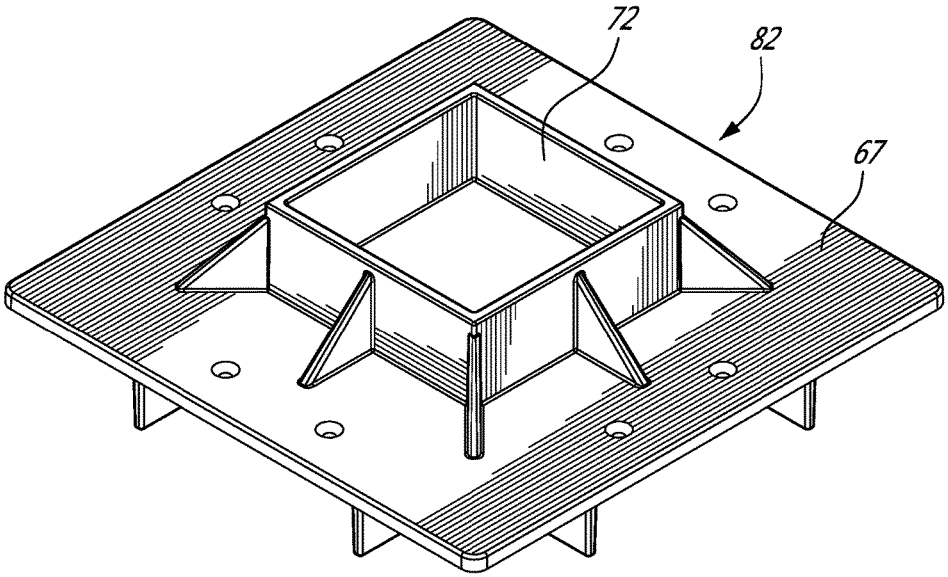
Figure 9B:
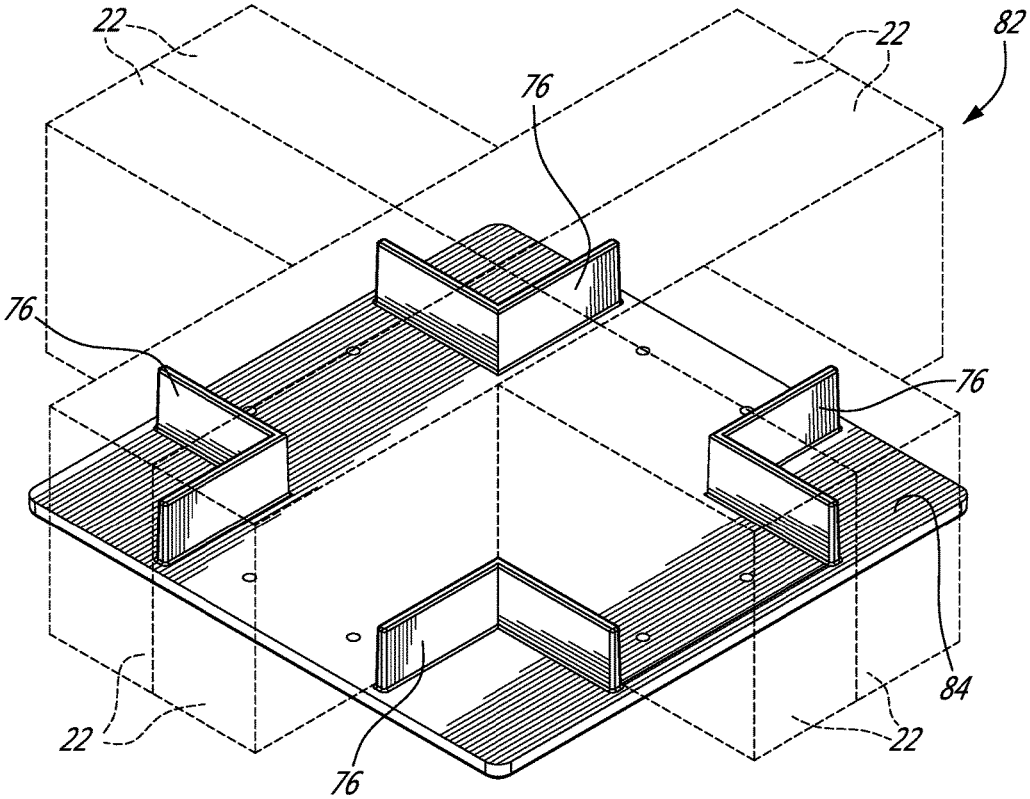

The anchor 82 shown in FIGS. 9A-9B is configured to receive four pairs of side by side ledgers 22, joists 24 or more generally beams, that intersects and are abutted so as to yield a cross configuration (see on FIG. 2). For that purpose, the beam-receiving side 84 is provided with four L-shaped walls 76 near the corner thereof that defines a generally cross-shaped area in the middle to receiving the pieces of lumber 22 therein. Also, the rectangular wall 72 on the post-receiving side 88 is centered on the plate 67.

Figure 10A:
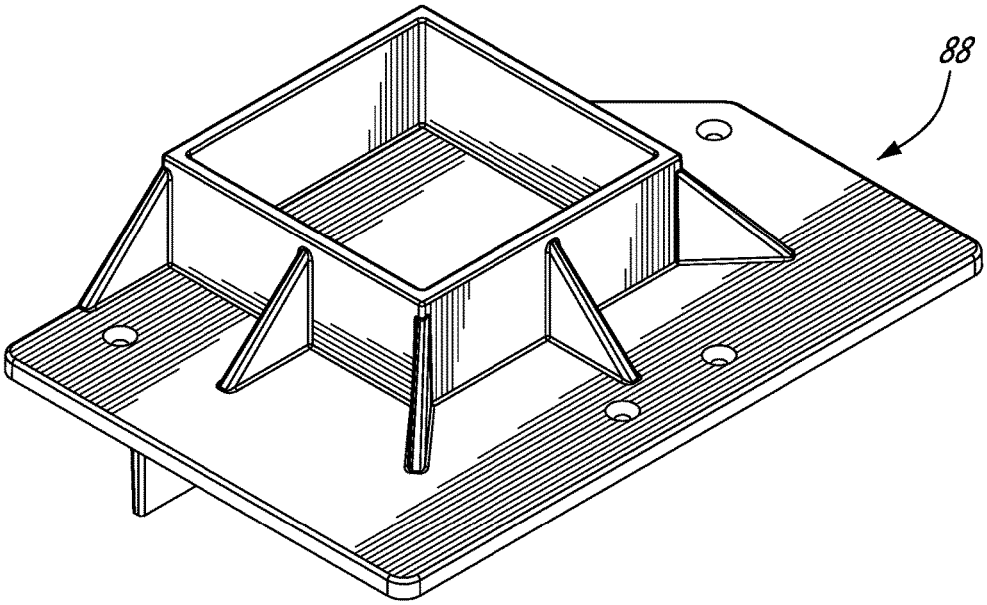
Figure 10B:
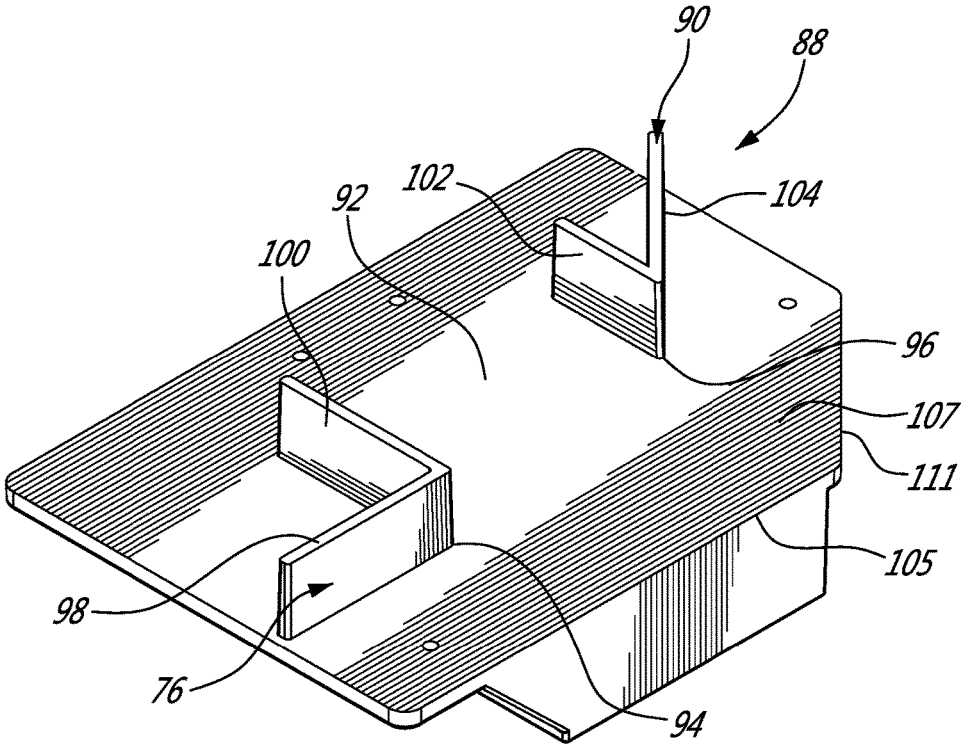

The anchor 88 of FIGS. 10A-10B is configured to join a rectangular-shaped platform 49 and a rectangular-shaped platform 12 via respective corners thereof (see FIG. 2).

The anchor 88 is similar to the anchor 20 of FIGS. 6A-6B with, as a first difference, an additional length to accommodate a triangular shaped wall 90 in addition to the L-shaped wall 76. The gap 92 therebetween defines a track that allows receiving two side by side ledgers 22 in a snugly-fit manner (see on FIG. 2). Both intersections 94 and 96 of the walls 98-100 and 102-104 that defines the L-shaped and V-shaped walls 76 and 90 are aligned to define a further positioning guide for the longitudinal ends of the ledgers 22. The edge 105 of the anchor 88, which is parallel to the axis defined by the intersections 94 and 96 acts as a further positioning guide for the intersecting beveled ends of two other ledgers 22 that are positioned along the unparalleled walls 98 and 104. The plate 107 has a truncated corner 111 that conforms to the peripheral configuration of the resulting deck (see FIG. 2).

Figure 11A:
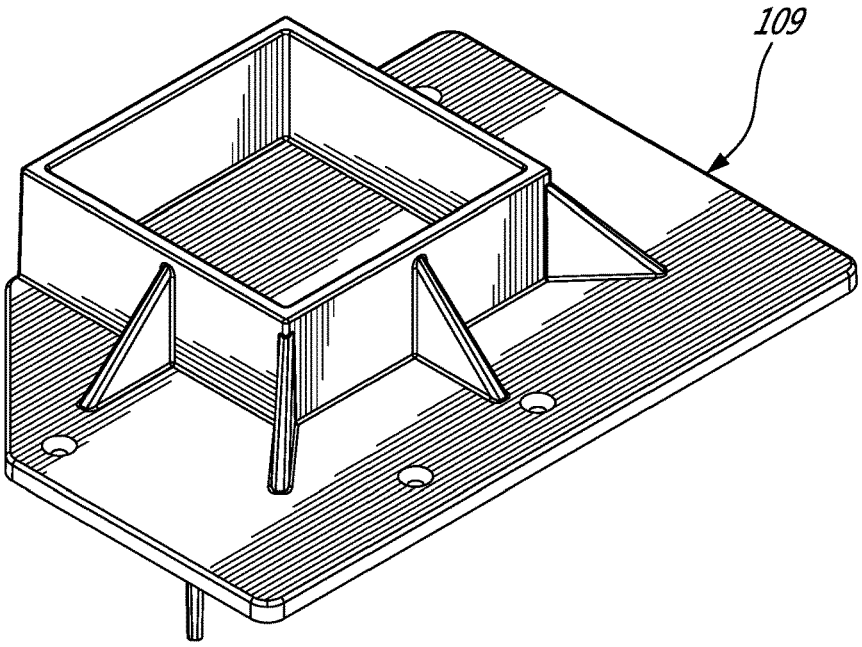
Figure 11B:
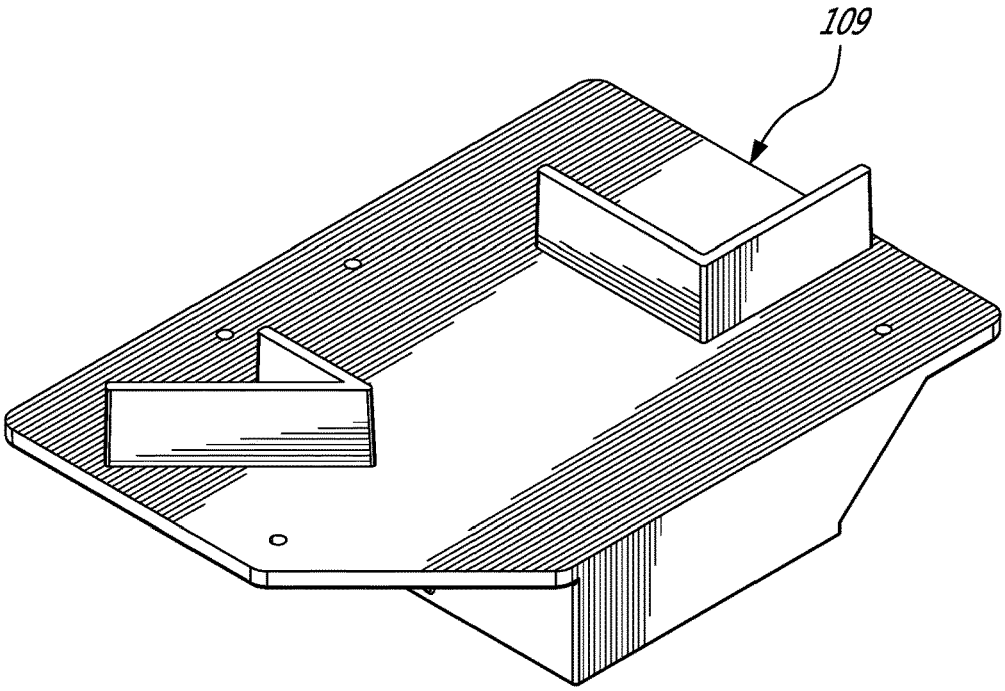
Figure 12A:
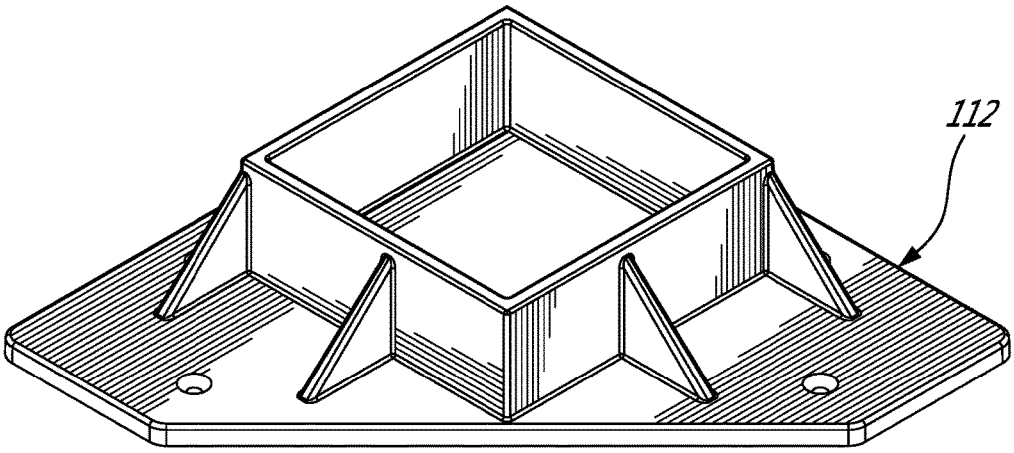
Figure 12B:
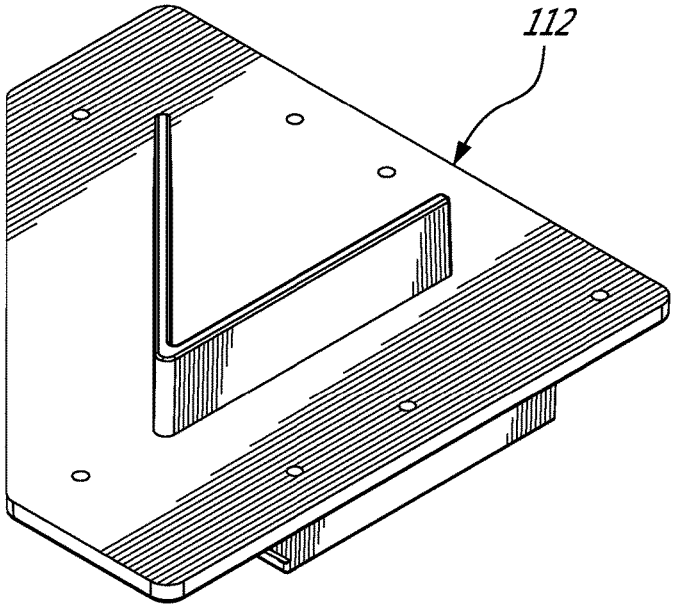
Figure 13A:
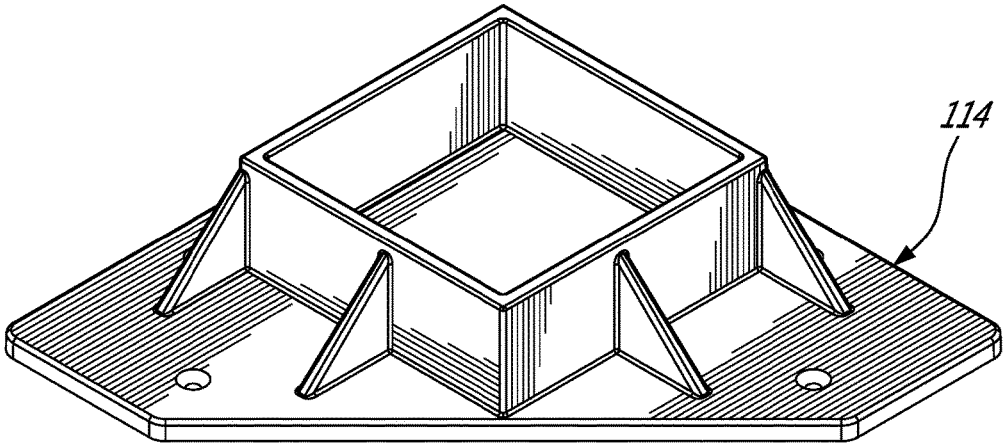
Figure 13B:
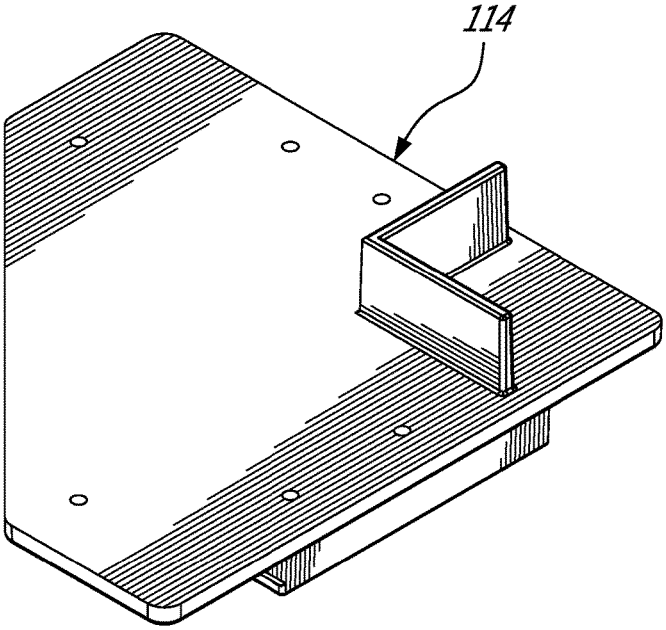
Figure 14A:
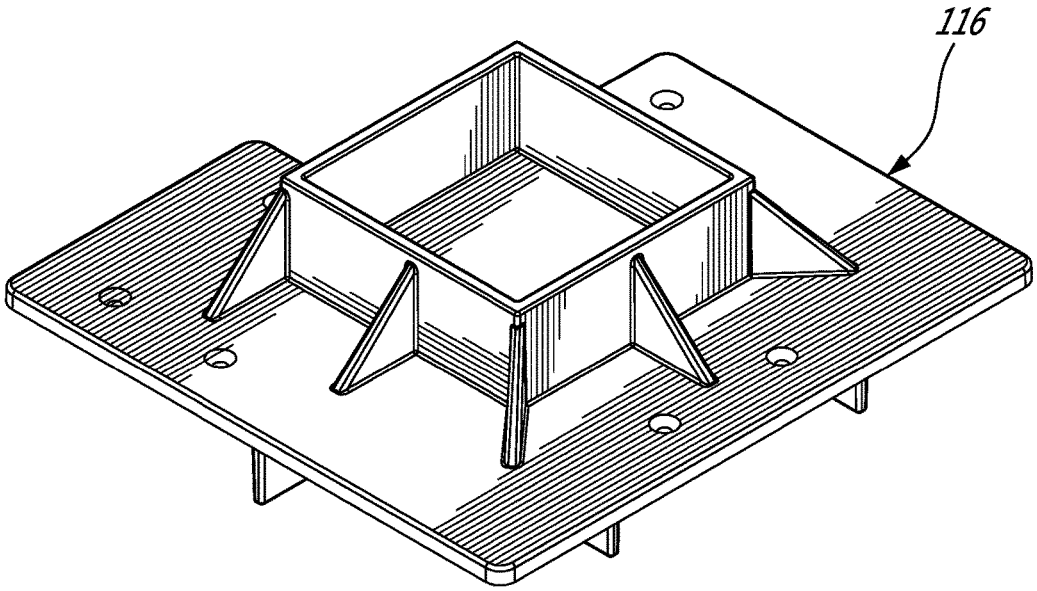
Figure 14B:
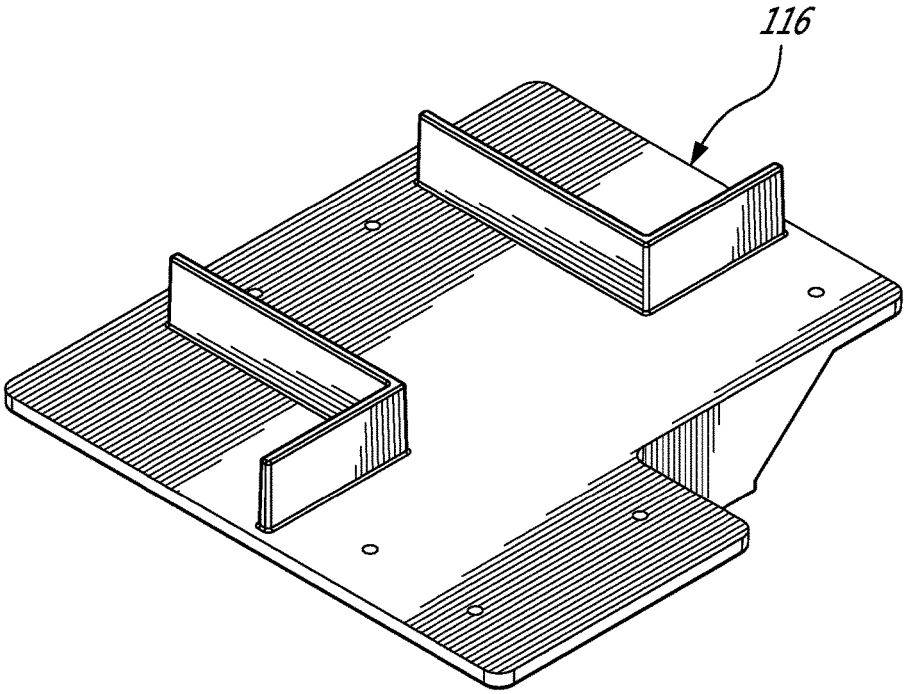
Figure 15A:
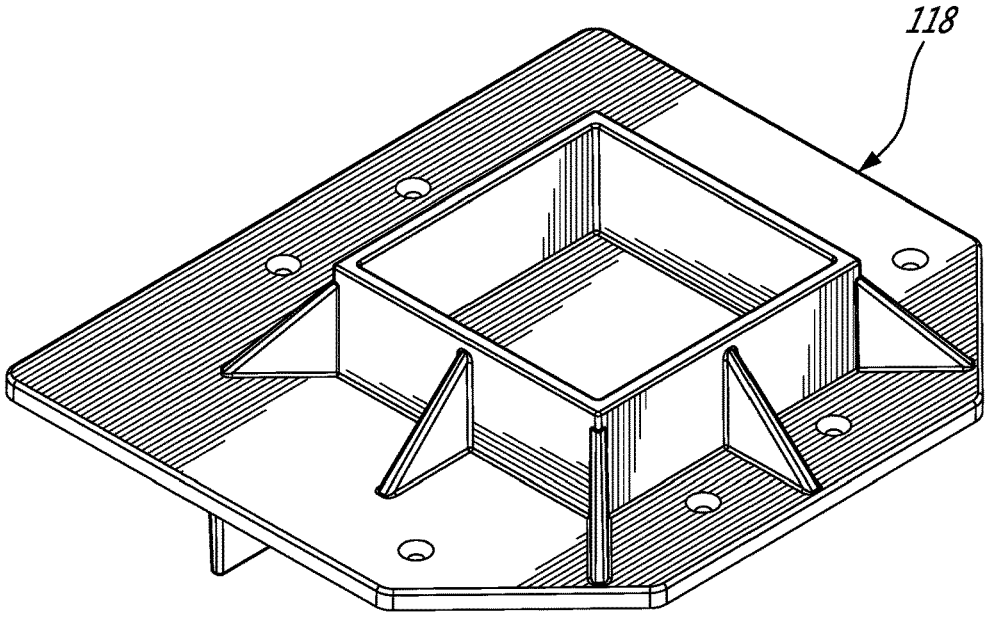
Figure 15B:
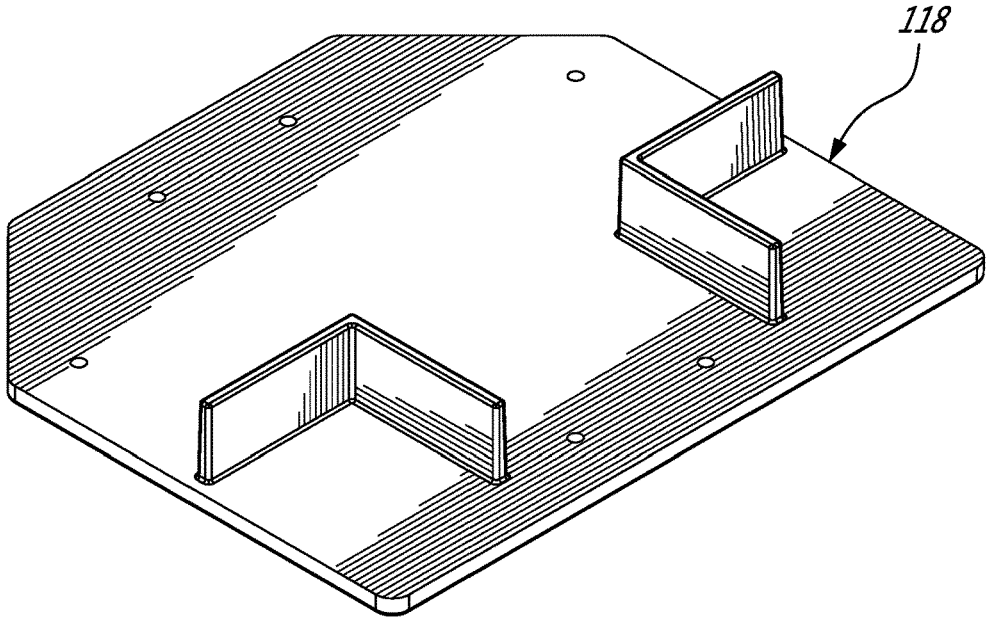
Figure 16A:
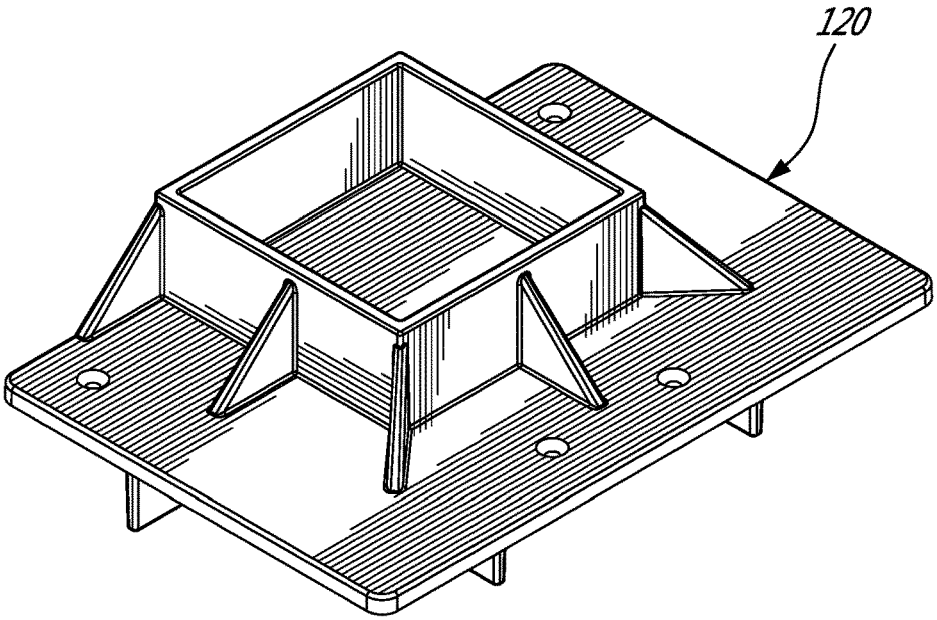
Figure 16B:
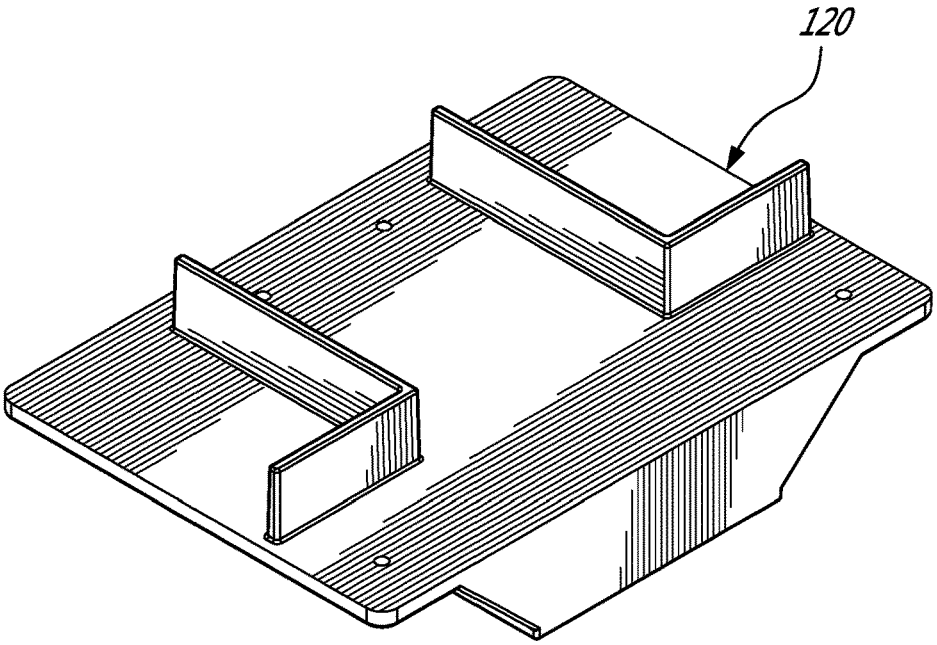

FIGS. 11A-11B shows an anchor 109 that is symmetrical to the anchor 88.

FIGS. 12A-16B shows anchors 112-120 according to other illustrative embodiments.

Generally stated, these anchors 112-120 includes one or more L and/or V-shaped walls 76, 90 that define abutting guide surfaces thereon and/or therebetween for ledgers, joists and more generally deck-elements. The angle defined by the V-shaped walls contributes to defining the relative angle between two deck elements.

The number, configuration and relative positions of the positioning guide members on the deck-element-receiving side may vary, and so is the general configuration of the anchor. For example, the plate can be omitted.

A person skilled in the art will appreciate that the anchors 20 are not limited to the assembly of decks, patios or the likes and can be used to interconnect beams, posts, etc. from other constructions.

Figure 17B:
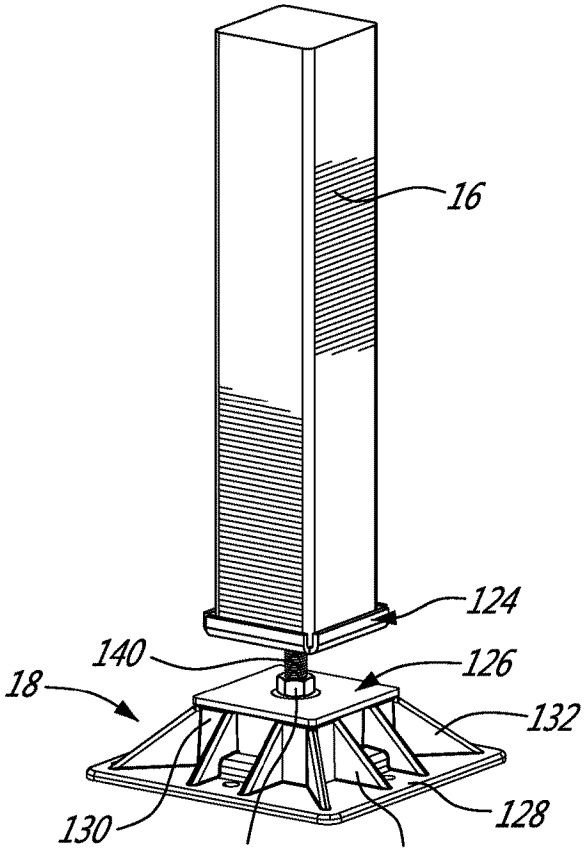
FIGS. 17A-17B are respectively an exploded perspective and a perspective of a structural piers for a post of the deck from FIG. 1 according to a first illustrative embodiment.
Figure 17A:
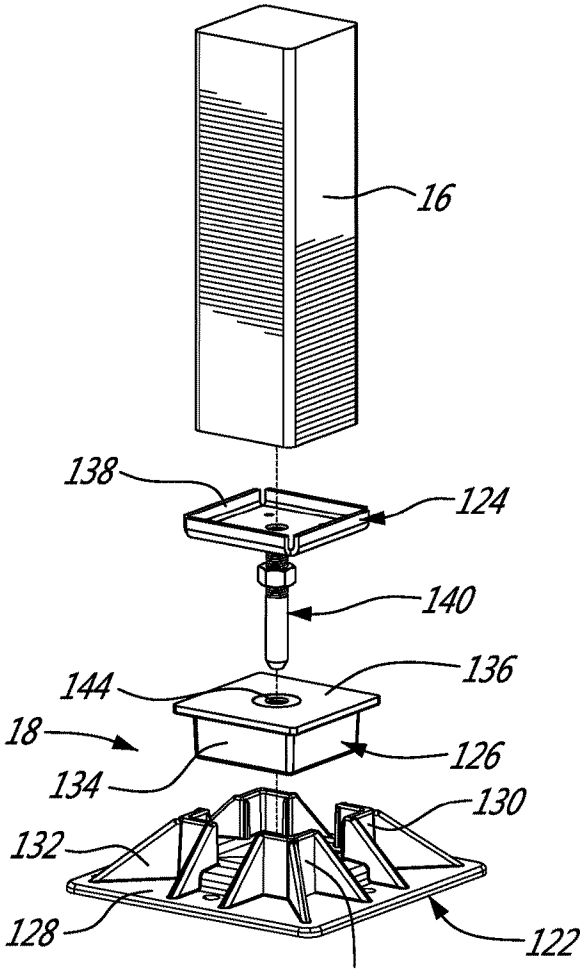

With reference to FIGS. 17A-17B, an adjustable structural pier 18 will now be described. The structural piers 18 includes a support receptacle 122 to rest on the ground, a swivel adjustable plate 124 for receiving a post 16, and a coupler block 126 for mounting the plate 124 to the receptacle 122.

The receptacle 122 is a one-piece plastic body including a generally rectangular plate 128 and four (4) L-shaped walls 130 that extend from the plate 128 to define a rectangular enclosure. The receptacle 122 further includes wall-reinforcing elements 132 that extend from both the plate 128 and walls 130 therebetween.

The coupler block 126 is a one-piece plastic body that includes a generally rectangular section 134 that is configured and sized to be complementary received within the walls 130 of the receptacle 122, and an enlarged portion 136 that is configured to rest on the edge of the walls 130 when the block 126 is inserted into the enclosure defined thereby.

The swivel adjustable plate 124 includes a thin box 138 that is shaped for complementary receiving the longitudinal end of a post 16. A threaded rod 140 has one of its end fixedly secured to the underside of the box. The top portion of the coupler block 126 includes an aperture 144 to receive the rod 140. A person skilled in the art will now appreciate that the distance between the box 138 and block 126 can be adjusted by varying the position of a nut 146 along the rod 140. The foot 18 thereby allows to readily adjusting the height of a post 16, for example when the deck 10 is mounted on an uneven ground.

The adjustable structural pier 18 is of course not limited to the above-described embodiment. For example, the enclosure defined by the walls 130 and the coupler block 126 can have other shape than rectangle. Also, other elements than a box 138 can be used to receive the post 16. The block 126 and receptacle 122 can also be integral or the block 126 can be omitted.

In some application, the receptacle 122 can be used to directly receive a post 16.

Figure 18:
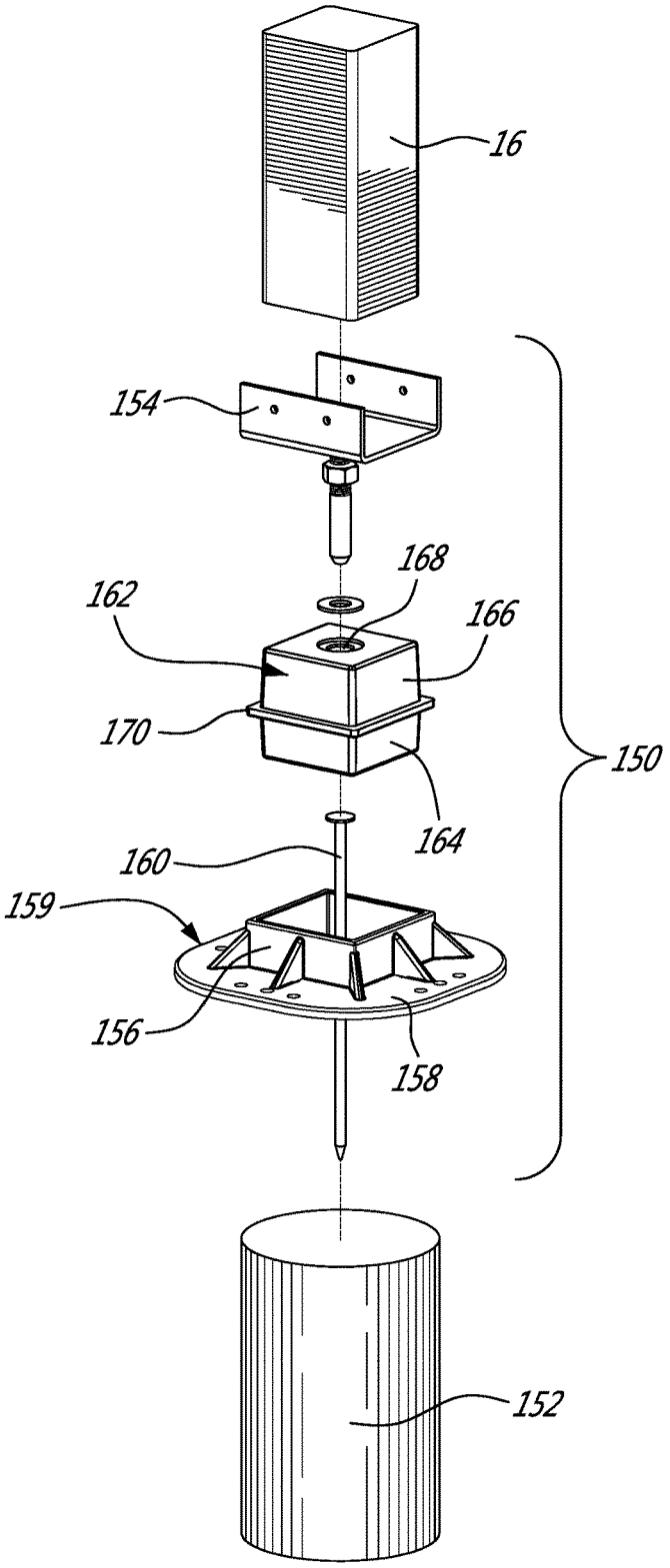
FIG. 18 is an exploded perspective of a structural piers according to a second illustrative embodiment.

FIG. 18 shows an adjustable structural pier 150 according to a further illustrative embodiment. The pier 150 is adapted to securing a post 16 to a cylindrical concrete pier 152. Since the pier 150 is similar to the pier 18, only the differences therebetween will be described herein in more detail for concision purposes.

The plate 124 from the pier 18 is replaced by a U-shaped bracket 154. The receptacle 159 is defined by a rectangular wall 156 that extends upwardly from a rounded plate 158. A concrete nail 160 or other fasteners can be used to secure the plate 158 to a concrete pier 152. Finally, the coupler block 162 is a one-piece plastic body that includes a first rectangular section 164 that is configured and sized to be complementary received within the wall 156, a second rectangular section 166 that includes a rod-receiving aperture 168 and an enlarged portion 170 between the sections 154 and 166 that is configured to rest on the edge of the walls 156 when the block 162 is inserted into the enclosure defined thereby.

Returning briefly to FIGS. 1A and 1B, reinforcing metal or polymeric rods 172 can be further used between the posts 16 and peripheral beams 22 of the structure 14 therebetween to add rigidity to the resulting deck 10.

Also, as can be used with reference to FIG. 1A, the posts 16 are not limited to being of the same length or they can be cut on site so as to be adapted thereto.

A deck, patio or the likes made from a kit as described hereinabove is not limited to being made of any particular material. Also, the kit may include a different quantity of elements described hereinabove. As mentioned hereinabove, the kit may include elements to assemble a frame structure of given size and configuration, and other elements of a deck, such as posts, tiles, etc. may be provided separately.

Although an anchor for securing deck elements to a post, and a deck assembly therewith have been described hereinabove by way of illustrative embodiments thereof, they can be modified. It is therefore to be understood that numerous modifications may be made to the illustrative embodiments and that the scope of the claims should not be limited by the preferred embodiment, but should be given the broadest interpretation consistent with the description as a whole.

What is claimed is:

1. An anchor for securing a post to deck elements comprising:

a one-piece body having first and second opposite sides; the body including a plate portion having top and bottom halves corresponding respectively to the first and second sides of the body;

the first side of the body having an opening for receiving the post along a first axis in a snugly-fit manner; the opening for receiving the post being defined by walls extending from the plate portion;

the second side of the body having:

at least one deck elements-receiving surface oriented generally perpendicular to the first axis for securing the deck elements thereon, positioning guide members extending from the at least one deck elements-receiving surface so as to define therewith areas for receiving and relative positioning of the deck elements on the at least one deck elements-receiving surface so that at least two of the positioning guide members are non-parallel; the positioning guide members defining guide surfaces for abutting thereon the deck elements received on the at least one deck elements-receiving surface; and fastener-receiving holes through the plate portion within the areas for receiving and relative positioning of the deck elements thereto; the fastener-receiving holes being positioned, on the first side of the body, outside a periphery defined by the walls.

2. The anchor as recited in claim 1, wherein the positioning guide members include at least one wall extending from the at least one surface.

3. The anchor as recited in claim 2, wherein the at least one wall is generally L-shaped.

4. The anchor as recited in claim 2, wherein the at least one wall is generally V-shaped.

5. The anchor as recited in claim 1, wherein the positioning guide members include at least one of i) an L-shaped wall, ii) a V-shaped wall, or iii) a combination thereof.

6. The anchor as recited in claim 1, wherein the plate portion is generally rectangular.

7. The anchor as recited in claim 6, wherein the plate portion has at least one truncated corner.

8. The anchor as recited in claim 1 that is made of a polymeric material.

9. The anchor as recited in claim 1, wherein the opening for receiving the post has a generally rectangular section.

* * * * *